United States Patent [19]

Baxendale

[11] 4,307,387

[45] Dec. 22, 1981

[54] VIBRATION-RESPONSIVE INTRUDER ALARM SYSTEM

[75] Inventor: Roy Baxendale, Harpenden, England

[73] Assignee: Elliott Brothers (London) Limited, Chelmsford, England

[21] Appl. No.: 123,438

[22] Filed: Feb. 20, 1980

[30] Foreign Application Priority Data

Feb. 23, 1979 [GB] United Kingdom ..... 06598/79

[51] Int. Cl.[3] ..... G08B 13/22

[52] U.S. Cl. ..... 340/566; 307/117; 340/550

[58] Field of Search ..... 340/566, 550, 65; 307/117

[56] References Cited

U.S. PATENT DOCUMENTS

| | | | |
|---|---|---|---|
| 3,614,724 | 10/1971 | Brown et al. | 340/566 |
| 3,913,085 | 10/1975 | Farstad | 340/566 |
| 4,090,180 | 5/1978 | Barowitz et al. | 340/566 |
| 4,097,025 | 6/1978 | Dettmann et al. | 340/566 |
| 4,107,660 | 8/1978 | Chleboun | 340/566 |

*Primary Examiner*—Glen R. Swann, III

*Attorney, Agent, or Firm*—Kirschstein, Kirschstein, Ottinger & Cobrin

[57] ABSTRACT

The effects of wind noise signals from fence-mounted transducers are overcome by basing alarm indications on signal components in at least two narrow frequency bands centered on, say, 120 Hz and 240 Hz.

4 Claims, 2 Drawing Figures

VIBRATION-RESPONSIVE INTRUDER ALARM SYSTEM

The present invention relates to vibration-responsive intruder alarm systems.

SUMMARY OF THE INVENTION

In particular the invention is concerned with intruder alarm systems of the kind comprising one or more electromechanical transducers responsive to incident vibrations to provide electric signals from which an alarm indication may be derived.

According to the present invention an intruder alarm system comprises one or more electro-mechanical transducers that provide electric signals in response to vibrations incident upon said one or more transducers, which electric signals may extend over a range of frequencies, first and second bandpass filters to pass electric signal components in respective bands of frequencies within said range, means to rectify said respective signal components and means selectively to apply one of the rectified signal components to an integrating circuit during periods when the value of the other of said rectified signal components exceeds a predetermined threshold value, an alarm indication being given if the output of said integrating circuit then exceeds a given level.

Preferably said one of the rectified signal components is applied to said integrating circuit only when it exceeds a respective predetermined threshold value. The other of said rectified signal components may be utilised to operate switching means, such as an electromagnetic relay, by way of which said one of the rectified signal components is applied to said integrating circuit.

BRIEF DESCRIPTION OF THE DRAWINGS

A vibration-responsive intruder alarm system in accordance with the invention will now be described with reference to the accompanying drawings, of which.

DETAILED DESCRIPTION OF THE INVENTION

Figure 1:
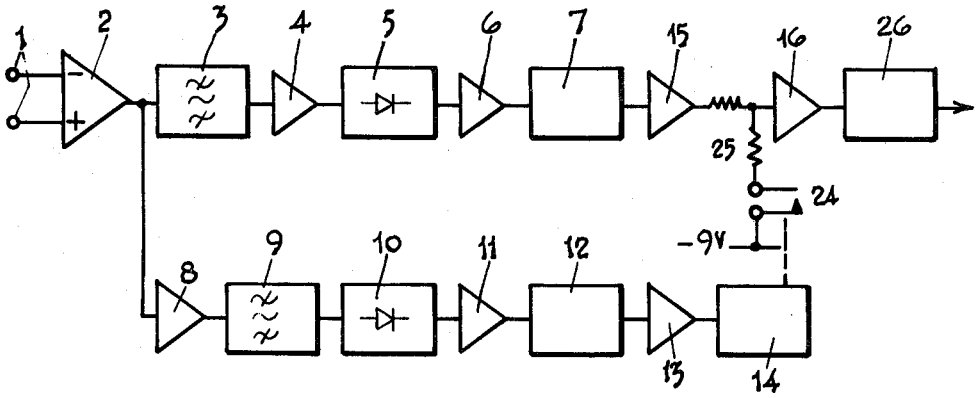
FIG. 1 shows part of the system schematically.

Referring to the drawing the intruder alarm system comprises one or more electro-mechanical transducers (not shown) connected between input terminals 1 of a broadband amplifier 2. The output of the amplifier 2 is connected by way of a band-pass filter 3 and a variable-gain amplifier 4 to a rectifier circuit 5, the output of which in turn is connected to a threshold voltage circuit 7 by way of a buffer amplifier 6. The output of the amplifier 2 is also connected by way of a variable gain amplifier 8 and a band-pass filter 9 to a rectifier circuit 10, the output of which is connected by way of a buffer amplifier 11 to a threshold voltage circuit 12. The output of the threshold circuit 12 is applied by way of an inverting driver amplifier 13 to the energising circuit of a relay 14, while the output of the threshold circuit 7 is applied by way of buffer amplifiers 15 and 16 to an integrator circuit 26.

Figure 2:
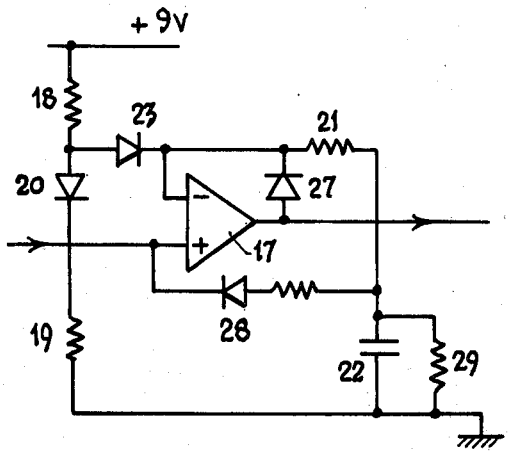
FIG. 2 shows in greater detail a part of the system shown in FIG. 1.

Each of the threshold circuits 7 and 12 is of the form shown in FIG. 2, a threshold voltage being established at the inverting input of a differential amplifier 17 either from a divider circuit comprising resistors 18 and 19 and a semiconductor diode 20 or from a circuit comprising a resistor 21 and a capacitor 22. A minimum threshold voltage of about half a volt positive with respect to earth from the divider circuit is applied to the inverting input of the amplifier 17 by way of a semiconductor diode 23, while positive-going unidirectional signal components from the respective rectifier circuit 5 or 10 are applied to the non-inverting input of the amplifier 17.

In operation the electromechanical transducer or transducers provide electric signals representing in frequency and amplitude the corresponding characteristics of any vibrations of the fence or other structure to which the transducers are attached. Any frequency components of these electric signals that lie within the pass-bands of the filters 3 and 9 are rectified and passed to the respective threshold circuits 7 and 12.

While the rectified signal components applied to the threshold circuit 12 remain below the minimum threshold voltage the relay 14 is arranged to be energised by the driver amplifier 13, so that its normally open contacts 24 of the relay 14 are closed to apply minus nine volts to the input of the buffer amplifier 16 by way of a one hundred ohm resistor 25. This effectively prevents any signal components in the pass-band of the filter 3 from reaching the integrator circuit 26.

When the rectified signal components applied to the threshold circuit 12 exceed the minimum threshold voltage the relay 14 is arranged to be de-energised, so that its contacts 24 open, while the respective capacitor 22 in the threshold circuit 12 is charged to a positive voltage, by way of a semiconductor diode 27 and the resistor 21, from the output of the amplifier 17. At the same time the diode 27 provides substantially unity feedback from the output of the amplifier 17 to its inverting input, so that the amplifier 17 exhibits substantially unity gain overall.

If a particular signal component amplitude in excess of the minimum threshold value persists for any length of time, as may happen in the case of vibrations due to wind, the capacitor 22 will become charged to substantially the output voltage of the amplifier 17, and unless the signal component amplitude subsequently falls by more than some seven tenths of a volt, such that a diode 28 becomes forward biased, the capacitor 22 will discharge only very slowly by way of a high value resistor 29. The voltage on the capacitor 22 will then become the new threshold voltage, since the diode 23 will be reverse-biased by the higher positive voltage on its cathode, and this higher voltage will serve to discriminate against wind vibrations of light to moderate intensity.

If signal components above the respective threshold values occur in both frequency bands the relay 14 is de-energised so that its contact 24 opens and the rectified signal components passed by the circuit 7 are applied to the integrator circuit 26. If the signal components in the two bands then persist, such that the output voltage of the integrator 26 exceeds a predetermined value, an alarm indication will be given. A timing circuit (not shown) may be arranged to reset the integrator circuit 26 a predetermined interval of, say, seventeen seconds after integration has been initiated, this timing circuit being activated when the output voltage of the integrator circuit exceeds twenty percent of the above-mentioned predetermined value. The resetting prevents any long term accumulation of isolated charges in the integrator 26 due to the effects of moderate wind vibrations.

Depending on the nature of the fence or other structure on which the transducer or transducers are mounted the pass-bands of the filter 9 may be centred on a frequency of the order of 80 Hz to 120 Hz, with the pass-band of the filter 3 centred on a frequency from one and a half to three times and preferably twice that of the filter 9, that is, in the range 160 Hz to 240 Hz. In the case in the case of a filter 9 whose pass-band is centred on 120 Hz the 3 dB bandwidth may be, say, 22 Hz, while in the corresponding case of the filter 3 whose pass-band is centred on 240 Hz its 3 dB bandwidth may be 41 Hz.

According to another aspect of the present invention an intruder alarm system for providing an alarm indication in response to vibrations of a fence or like structure comprises one or more electromechanical transducers attached to or coupled to said fence or like structure, which transducer or transducers provide electric signals which may extend over a range of frequencies in response to vibrations incident thereon, two or more bandpass filters to pass electric signal components in respective bands of frequencies within said range, and means to derive said alarm indication in dependence upon signal components in two or more of said bands of frequencies.

I claim:

1. A vibration-responsive intruder alarm system comprising one or more electro-mechanical transducers that provide electric signals in response to vibrations incident upon said one or more transducers, which electric signals may extend over a range of frequencies, first and second bandpass filters to pass electric signal components in respective bands of frequencies within said range, means to rectify said respective signal components and means selectively to apply one of the rectified signal components to an integrating circuit during periods when the value of the other of said rectified signal components exceeds a predetermined threshold value, an alarm indication being given if the output of said integrating circuit then exceeds a given level.

2. An intruder alarm system in accordance with claim 1 wherein said one of the rectified signal components is applied to said integrating circuit only when it exceeds a respective predetermined threshold value.

3. An intruder alarm system in accordance with claim 2 wherein the means selectively to apply said one of the rectified signal components to said integrating circuit comprises switching means responsive to the value of the other of said rectified signal components.

4. An intruder alarm system in accordance with claim 3 wherein said switching means comprises an electromagnetic relay.

* * * * *